US006299967B1

(12) United States Patent
Collins et al.

(10) Patent No.: US 6,299,967 B1
(45) Date of Patent: Oct. 9, 2001

(54) INK JET RECORDING MEDIA FOR USE IN MAKING TEMPORARY TATTOOS AND PROCESSES THEREOF

(75) Inventors: Mike Collins, Greene; Steven J. Sargeant, West Warwick; David Atherton, Saundestown, all of RI (US)

(73) Assignee: Arkwright Incorporated, Fiskeville, RI (US)

( * ) Notice: Subject to any disclaimer, the term of this patent is extended or adjusted under 35 U.S.C. 154(b) by 0 days.

(21) Appl. No.: 09/325,387

(22) Filed: Jun. 4, 1999

Related U.S. Application Data

(60) Provisional application No. 60/088,221, filed on Jun. 5, 1999.

(51) Int. Cl.[7] ..... B41M 5/00

(52) U.S. Cl. ..... 428/211; 428/195; 428/500; 428/524

(58) Field of Search ..... 428/195, 211, 428/500, 524

(56) References Cited

U.S. PATENT DOCUMENTS

| | | | |
|---|---|---|---|
| 4,169,169 | 9/1979 | Kitabatake . | |
| 4,594,276 | 6/1986 | Relyea . | |
| 5,015,263 | 5/1991 | Albrecht et al. . | |
| 5,421,765 | 6/1995 | Lehmann et al. . | |
| 5,601,859 | 2/1997 | Penaluna . | |
| 5,676,401 | 10/1997 | Witkowski et al. . | |
| 5,837,375 * | 11/1998 | Brault et al. | 428/195 |
| 5,958,560 | 9/1999 | Ewan . | |

FOREIGN PATENT DOCUMENTS

WO 97/42040 * 11/1997 (WO) .

* cited by examiner

*Primary Examiner*—Pamela R. Schwartz
(74) *Attorney, Agent, or Firm*—Birch, Stewart, Kolasch & Birch, LLP

(57) ABSTRACT

The present invention relates to ink jet recording media that are useful for making temporary tattoo images on human skin or other surfaces. The media comprise a water-soakable release-paper substrate coated with an ink jet imaging layer. The substrate is optionally coated with a water-insoluble protective layer. The media may further comprise a pressure-sensitive adhesive tape having a backing coated with a medical adhesive layer.

2 Claims, 1 Drawing Sheet

INK JET RECORDING MEDIA FOR USE IN MAKING TEMPORARY TATTOOS AND PROCESSES THEREOF

CROSS-REFERENCE TO RELATED APPLICATIONS

This application claims the benefit of U.S. provisional application Ser. No. 60/088,221 having a filing date of Jun. 5, 1999.

BACKGROUND OF THE INVENTION

1. Field of the Invention

The present invention relates to ink jet recording media that are useful for making temporary tattoo images on human skin or other surfaces. The media comprise a water-soakable release-paper substrate coated with an ink jet imaging layer.

2. Brief Description of the Related Art

In most human cultures, it is common to decorate the human body. Societies from the most primitive in technological development to the most sophisticated by today's standards tolerate, if not promote, such decoration. It is generally believed that the first efforts at adorning the human body involved using clays and ash to color the body. Stains and dyes from flora were also used early in the development of primitive societies. These types of adornment were used for various purposes including recognition of status, signaling of marital intent or status, enhancing attractiveness to suitors, providing religious and ceremonial markings, and creation of a fearsome or frightening visage.

These types of decorations tended to be rather crude, consisting of course lines and designs. The materials used were not always readily available and the toxicological, allergenic, and bacteriological properties of the materials tended to lack control. As societies became more sophisticated, decorating the body became more specific, depending on the body part. For example, more permanent and durable coloring solutions were used on the nails of the hands and feet, brightly colored waxes were used on the lips, tacky powders were used on the cheeks, and thick, dark oil or graphite-based materials were used around the eyes. These basic decorations are still used in modified form today.

More stylized or artistic decorations of the human body have always been desired by certain portions of society. Tattoos have been used as decorations of the human body for many centuries. Tattoos developed from the techniques of scarring the body to form patterns or images by texturing the flesh of a person. Deep abrasion and cutting of the skin causes areas of the skin to rise and form scars. It was probably noted after the use of dirty or colored scarring tools that coloration of the scarred flesh occurred. Purposeful addition of colorants forced under the skin by tools then followed. Modem tattoos use medical-quality needles to inject non-fugitive dyes and pigments in subcutaneous patterns that are visible. The process of applying tattoos is both painful and costly, and the image is permanent.

A number of tattoo imitations have been developed to give the appearance of detailed skin or body images without the permanency or pain involved with tattoos. The three major types of substitutes include painted images, transferable dye images, and decal images.

Painted images require the artistic efforts of a painter to provide a good quality image. Painted images are relatively expensive, but provide an infinite variety of high quality images.

For transferable-dye images, water-soluble dyes are usually painted on a substrate in a pattern or image. The wetted dyes are then pressed against the skin, thus transferring them to the skin. This method tends to produce streaked, smeared and partial images. The dyes are water-soluble and will run and streak easily from perspiration or other liquids. However, in some instances, transferable-dye images are very similar to body tattoos.

Decal tattoo imitations comprise a printed image on a substrate with an adhesive material on the other side of the substrate. These decals tend to appear highly artificial. Currently available decal body tattoos have been successfully marketed for many years, but they appear little better than Band-Aids® with printed images on them.

Relyea, U.S. Pat. No. 4,594,276 discloses a printed, removable, body tattoo on a translucent substrate. The substrate is a flexible, porous, non-woven, compacted tissue substrate which is translucent and which has on one surface a printed image and a pressure sensitive adhesive on the other surface of the substrate.

Kitabatake, U.S. Pat. No. 4,169,169 discloses a transfer process and a transfer sheet for use therein, where the process includes the steps of (a) providing a transfer sheet comprising a substrate and a pattern layer comprising lower alcohol-soluble, water-insoluble dyes provided on at least one surface of the substrate, (b) wetting the pattern layer of the transfer sheet with a transfer solution containing lower alcohols and bringing the transfer sheet into close contact with a receiving surface onto which the pattern is to be transferred in such a manner that the pattern layer contacts the receiving surface, (c) maintaining the transfer sheet in close contact with the receiving surface under pressure, and (d) peeling the transfer sheet from the receiving surface thereby to leave a transferred pattern corresponding to the pattern to the transfer sheet on the receiving surface.

Albrecht et al., U.S. Pat. No. 5,015,263 discloses a composition for coloring skin comprising a carrier containing an alcohol component consisting of and aromatic alcohol, and aliphatic alcohol or mixtures thereof and certain certified acid dyes, with the composition having an acid pH equal to or less than 4.

Witkowski et al., U.S. Pat. No. 5,676,401 discloses a label for a container in the form or a metallic generally cylindrical can or glass or plastic bottle wherein the label encompasses and surrounds the outer side surface of the container, the label carrying suitable advertising matter on the exterior surface of the label, and the internal surface of the label having printed thereon on one or more removable temporary transfer tattoos, which are water soluble and can be easily transferred from the label to the skin of a child for his or her enjoyment and entertainment.

Lehmann et al., U.S. Pat. No. 5,421,765 discloses a toy tattoo playset that includes simulated tattoos that are non-toxic water-soluble adhesive backed prints having decorative designs and/or legends.

Penaluna, U.S. Pat. 5,601,859 discloses a chewing gum product comprising a wrapper, wherein the wrapper on the side in contact with the gum is coated with wax, and the other side of the wrapper contains no wax or adhesive and carries at least one complete design of ink comprising vegetable dye and polyvinyl alcohol, which is transferable as a tattoo by wetting the design with water and pressing it against the surface to which the tattoo is to be transferred.

SUMMARY OF THE INVENTION

The present invention provides ink jet recording media that are useful for making temporary tattoo images on human skin or other surfaces. The media comprise a water-soakable release-paper substrate coated with an ink jet imaging layer. The substrate may be coated with a water-insoluble protective layer and an ink jet imaging layer, wherein the imaging layer is coated onto the protective layer.

Preferably, the water-insoluble protective layer comprises polyvinylbutyral. Preferably, the imaging layer comprises a blend of poly(2-ethyl-2-oxazoline), cellulose acetate propionate, and poly(vinyl pyrrolidone) or a blend of a vinylpyrrolidone and dimethyl ammonium methacrylate copolymer, methyl methacrylate and hydroxyethyl methacrylate copolymer, and methylated melamine-formaldehyde resin.

The media may further comprise a pressure-sensitive adhesive tape having a backing coated with a medical adhesive layer.

This invention also encompasses a process for forming a temporary tattoo image on human skin or other surface. The process comprises the steps of: (a) imaging an ink jet recording medium comprising a water-soakable release paper substrate coated with an ink jet imaging layer, (b) applying a pressure-sensitive adhesive tape having a backing coated with an adhesive layer, preferably a medical adhesive, so that the adhesive layer adheres to the imaged portion of the medium, (c) removing the backing of the pressure-sensitive adhesive tape from the imaged portion of the medium so that the imaged portion having the adhered medical adhesive layer is exposed, (d) applying the medium to the skin or other surface such that the adhesive layer contacts the skin or other surface, (e) applying water to the paper substrate, and (f) removing the paper substrate from the skin or other surface to form a temporary tattoo image.

DETAILED DESCRIPTION OF THE INVENTION

Figure 1:
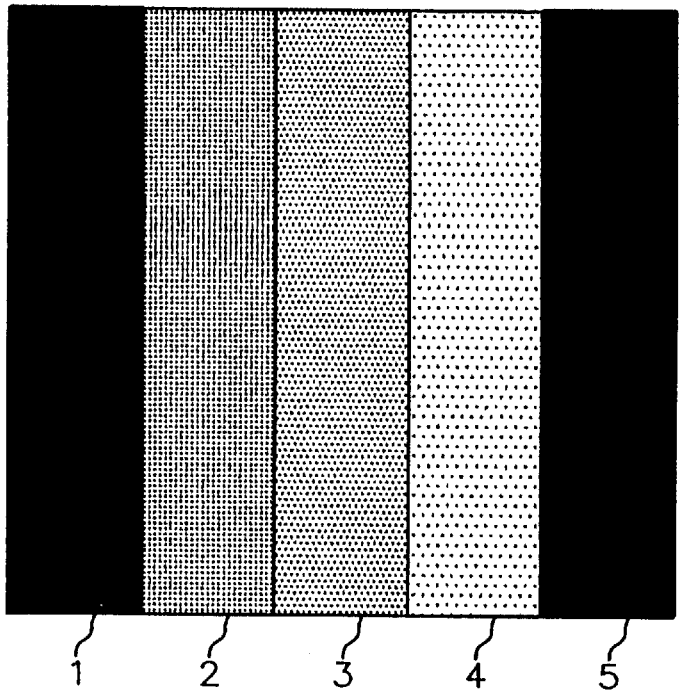
FIG. 1 provides a cross-sectional view of an ink jet recording medium of the instant invention, wherein a water-insoluble protective layer is present and a pressure-sensitive adhesive tape having a layer of a medical adhesive has been applied to the imaged portion of the medium.

The ink jet recording media of the present invention comprise a water-soakable release-paper substrate. Such release-paper substrates are known and are typically coated with a releasable coating. For example, SKINCAL®, manufactured by Brittains (T.R.) Limited, is a high-quality skin decal paper having a gum coating thereon. The gum coating is releasable and can be coated with an imaging layer. The paper substrate and gum coating can then be separated from the imaging layer. Other suitable substrates include conventional waterslide papers. By the term, "water-soakable release paper substrate" as used herein, it is meant a paper that is capable of being coated with an ink jet imaging layer and subsequently separated from the imaging layer by wetting with water or other suitable aqueous-based solvent.

Optionally, a water-insoluble protective layer is coated onto the substrate. The protective layer may comprise such water-insoluble polymers as polyvinylbutyral, cellulose acetate propionate, cellulose acetate butyrate, polyvinyl chloride, butyl rubber, chloroprene, and the like.

A non-optional ink jet imaging layer is coated directly onto the substrate, or water-insoluble protective layer, if present. By the term, "ink jet imaging layer", it is meant a composition that is receptive to ink from ink jet printing devices. If the water-insoluble protective layer is not present, it is preferred that the ink jet imaging layer be highly cross-linked linked so as to ensure that the temporary tattoo images possess a sufficient water-fastness. Of course, the highly cross-linked ink jet imaging layer can also be used in instances where the water-insoluble protecting layer is present.

The imaging layer may contain water-soluble and water-insoluble polymeric components. Examples of suitable water-soluble components include poly(vinyl alcohol), cellulose ethers, cellulose esters, poly(vinyl pyrrolidone), gelatins, poly(vinyl acetate), starch, poly(acrylic acids), poly (ethylene oxide), proteins, hydroxypropyl cyclodextrin, poly (2-ethyl-2-oxazoline), alginates, water-soluble gums, and the like. Examples of suitable water-insoluble components include poly(vinyl chloride), polyesters, poly(vinylidene fluoride), methyl methacrylate, styrene-acrylonitrile polymers, polyurethanes, polysulfones, butadienes, 2-hydroxyethyl acrylate, ethyl acrylate, N-hydroxyethyl acrylamide, N-hydroxymethylacrylamide, and polycarbonates.

Preferably, the imaging layer comprises a blend of poly (2-ethyl-2-oxazoline), cellulose acetate propionate, and poly (vinyl pyrrolidone) or a blend of a vinylpyrrolidone and dimethyl ammonium methacrylate copolymer, methyl methacrylate and hydroxyethyl methacrylate copolymer, and methylated melamine-formaldehyde resin.

It is recognized that any ink jet imaging coating may be used to form the imaging layer, provided that it can accept a tattoo image from an ink jet printer and can impart the image to a person's skin or other surface in such a manner that the image has sufficient water-fastness. Further, to the extent that a given coating composition does not have these properties, it may still be possible to use the coating in combination with the water-insoluble protective layer described above. This is possible because the water-insoluble protective layers are flexible and provide good water-fastness to the tattoo images.

The ink jet recording media of this invention may be used to form temporary tattoos on a person's skin or other solid surfaces such as glass.

This process involves first applying an image to the recording medium. Imaging of the medium can be carried out by using conventional ink jet printers, such as a Hewlett Packard Model HP 670 or HP 850 ink jet printer, a Canon model 620 or 240 ink jet printer, an Epson model 400 ink jet printer, or the like. An important feature of the media of this invention is that they can be imaged with a personalized tattoo. With the use of a personal computer, a suitable graphics program and an ink jet printer, one can transform an endless variety of designs into personalized temporary tattoos. Alternatively, the media can be imaged through by using inks, crayons, colored markers, pencils and the like. Even so, it is envisioned that most, if not all, persons desiring to prepare a temporary tattoo according to the instant invention, will utilize ink jet printers, since the quality of tattoo images produced using the inventive media in ink jet printers is quite good.

An adhesive layer is applied to the imaged medium by a suitable means. For human applications, a medical adhesive layer, preferably approved by the Food and Drug Administration (FDA), is applied. Preferably, a pressure-sensitive tape comprising a backing coated with a medical adhesive layer is applied to the imaged media. Examples of suitable pressure-sensitive adhesive tapes include 3M-512, UA-202, and Scapa Tape UP-304. These tapes are commercially available and contain a layer of medical adhesive coated on a backing material (substrate). The backing is removable from the layer of medical adhesive. Alternatively, an applicator brush, aerosol spray, or the like may be used to apply the medical adhesive layer to the imaged medium. However, for convenience sake and ease of use, it is preferable that a pressure-sensitive tape be used to apply the medical adhesive layer, since this results in a medium that can be easily handled.

The backing of the pressure-sensitive adhesive tape is then removed, thereby exposing the layer of medical adhesive. Next, the media is pressed against the skin so that the medical adhesive layer and skin contact each other. The paper substrate is then removed from the media by wetting with water, and a temporary tattoo image is formed. The temporary tattoo formed by this process has good characteristics that are generally associated with conventional tattoos, such as a good color, feel, and the like.

Figure 2:
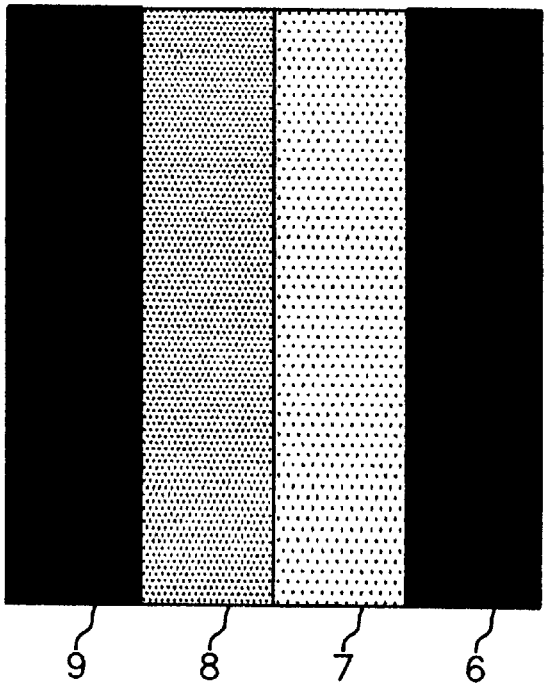
FIG. 2 provides a cross-sectional view of an ink jet recording medium of the instant invention, wherein a water-insoluble protective layer is not present and a pressure sensitive adhesive tape having a layer of a medical adhesive has been applied to the imaged portion of the medium.

The ink jet recording media of this invention are further illustrated in FIGS. 1 and 2. FIG. 1 is cross-sectional view of one embodiment of the ink jet recording media of this invention, wherein a pressure-sensitive adhesive tape comprising a backing (5) having a layer (4) of medical adhesive has been laminated to the imaged portion of an ink jet imaging layer (3). The medium further comprises a water-soakable release paper substrate (1) coated with a water-insoluble protective layer (2).

FIG. 2 is a cross-sectional view of one embodiment of the ink jet recording media of this invention, wherein a pressure-sensitive adhesive tape comprising a backing (6) having a layer (7) of medical adhesive has been laminated to the imaged portion of an ink jet imaging layer (8). The medium further comprises a water-soakable release paper substrate (9) coated with ink jet imaging layer (8).

In most instances, the media of this invention will be applied to a person's skin, and in such cases, the imaged portion of the imaging layer should be in the form of a mirror or reverse image of the desired tattoo design. This mirror or reverse image is necessary, because when the tattoo is applied to the skin, it is viewed from the backside, or opposite side, to the side it was imaged on. However, in the instance where the tattoo is applied to a solid surface such as a glass plate, or the like, which is clear and transparent, it may be possible to apply the tattoo image to the imaging layer in a non-reverse fashion and form a tattoo that can be properly viewed or read. In instances where the surface is opaque, the tattoo image should be applied in a reverse fashion, in order to be read or viewed properly after application of the tattoo to the surface.

The present invention is further illustrated by the following examples, but these examples should not be construed as limiting the scope of the invention.

EXAMPLES

Example I

| | |
|---|---|
| Water-Soakable Release-Paper | |
| SKINCAL ® | |
| Water-Insoluble Protective Coating | |
| Solids | 12 wt % |
| Polyvinylbutyral | |
| Solvent (Volatiles) | 88 wt % |
| Methanol | |
| Ink jet Imaging Coating | |
| Solids | |
| Poly(2-Ethyl-2-Oxazoline) | 14.94 wt % |
| Polymethyl Methacrylate Spheres (particle size 10 microns) | 0.04 wt % |
| Cellulose Acetate Propionate | 1.60 wt % |
| Polyvinyl Pyrrolidone | 1.25 wt % |
| Citric Acid | 0.09 wt % |
| Solvent (Volatiles) | |
| Methyl Ethyl Ketone | 39.36 wt % |
| Propylene Glycol Mono Ethyl Ether | 26.24 wt % |
| Ethanol | 16.43 wt % |

The gum-coated side of the SKINCAL® paper was treated with the above-described water-insoluble protective coating. The coating was applied using a No. 28 Mayer rod and dried for 3 minutes at 120° F. Next, the above-described ink jet imaging coating was applied to the dried water-insoluble protective layer using a No. 40 Mayer rod and dried for 3 minutes at 120° F. In this manner, an ink jet recording medium, suitable for forming a temporary tattoo, was prepared.

Example 2

| | |
|---|---|
| Water Soakable Release Paper | |
| SKINCAL ® | |
| Ink jet Imaging Coating layer | |
| Solids | |
| 1. Copolymer of vinylpyrrolidone and dimethyl Ammonium methacrylate (ISP Technologies) | 50 wt. % |
| 2. Copolymer of methyl methacrylate and hydroxyethyl methacrylate (Allied Colloids) | 10 wt. % |
| 3. Methylated melamine-formaldehyde resin (Cytec Industries) | 10 wt. % |
| Solvent (Volatiles) | |
| Methyl Ethyl Ketone | 20 wt. % |

The gum-coated side of the SKINCAL® paper was treated with the above-described highly cross-linked ink jet imaging coating. The coating was applied using a No. 40 Mayer rod and dried for 3 minutes at 120° F. In this manner, an ink jet recording medium, suitable for forming a temporary tattoo, was prepared.

What is claimed is:

1. An ink jet recording medium comprising a water-soakable release paper substrate coated with a water-insoluble protective layer and an ink jet imaging layer, wherein the imaging layer comprises a blend of poly(2-ethyl-2-oxazoline), cellulose acetate propionate, and poly (vinyl pyrrolidone).

2. An ink jet recording medium comprising a water-soakable release paper substrate coated with a water-insoluble protective layer and an ink jet imaging layer, wherein the ink jet imaging layer comprises a blend of a vinylpyrrolidone and dimethyl ammonium methacrylate copolymer, methyl methacrylate and hydroxyethyl methacrylate copolymer, and methylated melamine-formaldehyde resin.

* * * * *

UNITED STATES PATENT AND TRADEMARK OFFICE

CERTIFICATE OF CORRECTION

PATENT NO. : 6,299,967 B1
DATED : October 9, 2001
INVENTOR(S) : Mike Collins et al.

It is certified that error appears in the above-identified patent and that said Letters Patent is hereby corrected as shown below:

Title page,
Item [60], Related U.S. Application Data, please change "Provisional application No. 60/088,221, filed on Jun. 5, 1999" to -- Provisional application No. 60/088,221, filed on Jun. 5, 1998 --.

Signed and Sealed this

Tenth Day of September, 2002

*Attest:*

*Attesting Officer*

JAMES E. ROGAN
*Director of the United States Patent and Trademark Office*